US011161363B2

(12) United States Patent
Nagasawa et al.

(10) Patent No.: US 11,161,363 B2
(45) Date of Patent: Nov. 2, 2021

(54) SHEET TRANSFER APPARATUS AND BOOKBINDING APPARATUS

(71) Applicants: Keiichi Nagasawa, Yamanashi-ken (JP); Tetsuya Kawasaki, Yamanashi-ken (JP); Tsukasa Kondou, Yamanashi-ken (JP)

(72) Inventors: Keiichi Nagasawa, Yamanashi-ken (JP); Tetsuya Kawasaki, Yamanashi-ken (JP); Tsukasa Kondou, Yamanashi-ken (JP)

(73) Assignee: CANON FINETECH NISCA INC., Misato (JP)

( * ) Notice: Subject to any disclaimer, the term of this patent is extended or adjusted under 35 U.S.C. 154(b) by 150 days.

(21) Appl. No.: 16/536,667

(22) Filed: Aug. 9, 2019

(65) Prior Publication Data

US 2020/0047536 A1 Feb. 13, 2020

(30) Foreign Application Priority Data

Aug. 13, 2018 (JP) ..... JP2018-152170
Aug. 13, 2018 (JP) ..... JP2018-152171
Aug. 13, 2018 (JP) ..... JP2018-152172

(51) Int. Cl.
*B42C 3/00* (2006.01)
*B42C 1/12* (2006.01)

(52) U.S. Cl.
CPC . *B42C 3/00* (2013.01); *B42C 1/12* (2013.01)

(58) Field of Classification Search
CPC .... B42C 1/12; B42C 3/00; B42C 1/00; B42C 1/10; B42C 1/125; B42C 99/00; B65H 31/32; B65H 2402/31; B65H 2402/35; B65H 2701/1932
See application file for complete search history.

(56) References Cited

U.S. PATENT DOCUMENTS 8,231,321 B2 * 7/2012 Hasegawa ..... B26D 7/015 412/38

FOREIGN PATENT DOCUMENTS

| | | | |
|---|---|---|---|
| JP | H07-172674 | A | 7/1995 |
| JP | H10-194566 | A | 7/1998 |
| JP | 2005-305822 | A | 11/2005 |
| JP | 2007-031068 | A | 2/2007 |
| JP | 2016-124221 | A | 7/2016 |

* cited by examiner

*Primary Examiner* — Justin N Olamit
(74) *Attorney, Agent, or Firm* — Manabu Kanesaka

(57) ABSTRACT

A sheet transfer apparatus for transferring a sheet is provided with a back receiver section that rotates a sheet to transfer, and a support section that supports the back face of the back receiver section swingably. By this means, the back receiver section is capable of rotating smoothly.

14 Claims, 12 Drawing Sheets

SHEET TRANSFER APPARATUS AND BOOKBINDING APPARATUS

BACKGROUND OF THE INVENTION

1. Field of the Invention

The present invention relates to a sheet transfer apparatus for receiving a sheet to transfer to a predetermined position, and bookbinding apparatus provided with the sheet transfer apparatus.

2. Description of Related Arts

Conventionally, there is a known sheet post-processing apparatus which ties a plurality of sheets with images formed thereon in the shape of a booklet to discharge. This type of sheet post-processing apparatus is provided with a storage chamber for storing the discharged bunch of sheets to be removable. In Japanese Unexamined Patent Publication No. 2005-305822 is disclosed an apparatus for dropping a bunch of a plurality of sheets bound by a sheet binding processing section into a storage chamber to sequentially store in a state in which the bunch stands substantially in the vertical direction.

In this apparatus, since a plurality of sheet bunches is stored in the storage chamber in a state of standing, efforts are required to remove each sheet bunch manually, shift each sheet bunch to another place, or the like. Further, in transporting the sheet bunch removed in the state of standing to another place via transport means such as a conveyor, in order to stabilize the sheet bunch, it is necessary to place flat on a bunch-by-bunch basis.

SUMMARY OF THE INVENTION

A first invention is a sheet transfer apparatus for transferring a sheet, and the apparatus is provided with a holding section that receives one end side of a sheet to hold, a support section that supports the holding section rotatably, and a receiving section that receives the sheet which is transferred, while rotating by rotation of the holding section, where the holding section includes a back face on the side opposite to the side for receiving a bunch of sheets, and the support section includes a support face for supporting the back face side of the holding section.

A second invention is a sheet transfer apparatus for transferring a booklet comprised of a bunch of bound sheets, and the apparatus is provided with a back receiver section which receives a back portion of a booklet on a receiving face, and rotates the booklet about the back portion side of the booklet as a pivot, and a support member that comes into contact with a back face on the side opposite to the receiving face of the back receiver section to support the back receiver section, where the support member includes a curved support face, and the back receiver section shifts along the curved support face of the support member.

A third invention is a bookbinding apparatus for binding a plurality of sheets to prepare a booklet, and the apparatus is provided with a collecting section that collects a plurality of sheets, a binding section that binds a plurality of sheets collected in the collecting section, and a sheet transfer section that transfers a booklet prepared by binding the plurality of sheets in the binding section, where the transfer section includes a back receiver section which receives a back portion of the booklet on a receiving face, and rotates the booklet about the back portion side of the booklet as a pivot, a support member that supports a back face side on the side opposite to the receiving face of the back receiver section, and a receiving section that receives the booklet rotated about the back portion side as the pivot in the back receiver section.

DETAILED DESCRIPTION OF THE PREFERRED EMBODIMENT

Figure 1:
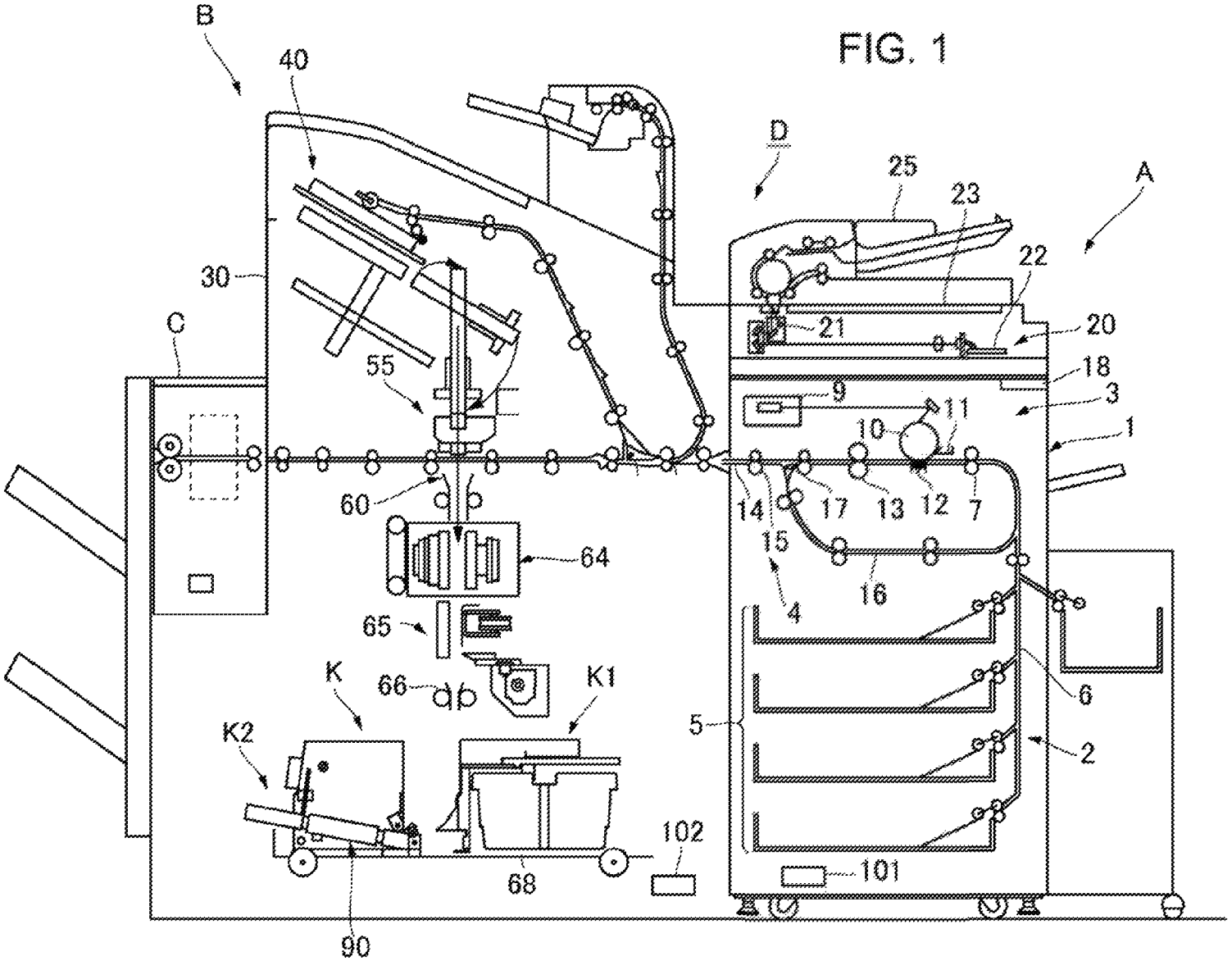
FIG. 1 is a cross-sectional schematic view along a sheet transport direction of an image forming system D.

An image forming system provided with a bookbinding apparatus including a sheet bunch discharge apparatus of one Embodiment of the present invention will be described below based on drawings. FIG. 1 is a cross-sectional schematic view along a sheet transport direction of an image forming system D.

The image forming system D is comprised of an image forming apparatus A for sequentially forming a toner image on a sheet, a bookbinding apparatus B disposed on the downstream side of the image forming apparatus A, and a post-processing apparatus C disposed downstream from the bookbinding apparatus B. The image forming system D is to perform bookbinding processing, on sheets with images formed in the image forming apparatus A, in the bookbinding apparatus B. Further, with respect to sheets on which the bookbinding processing is not performed, the image forming system D passes the sheet through the bookbinding apparatus B to undergo post-processing in the post-processing apparatus C, and discharges the sheet.

In the image forming apparatus A, into an apparatus main body 1 are incorporated a sheet supply section 2, image forming section 3, sheet discharge section 4 and image forming apparatus control section 101. In the sheet supply section 2, a plurality of cassettes 5 corresponding to respective sheet sizes is disposed in the vertical direction. The sheet supply section 2 feeds out a sheet of a size indicated from the image forming apparatus control section 101 to a feed path 6. The feed path 6 is provided with a register roller pair 7. The register roller pair 7 aligns a front end of the sheet, and then, feeds the sheet to the image forming section 3 on the downstream side at predetermined timing.

The image forming section 3 is provided with an electrostatic drum 10. Around the electrostatic drum 10 are disposed a printing head 9, developing device 11 and transfer charger 12. The printing head 9 is to form an electrostatic latent image on the electrostatic drum 10. The electrostatic latent image is subjected to toner development in the developing device 11 as a toner image, and the image is transferred to a sheet in the transfer charger 12. The toner image is fused in a fuser 13, and the sheet is sent to a sheet discharge path 17. In the sheet discharge section 4 is disposed a sheet discharge roller pair 15 for discharging the sheet from a sheet discharge opening 14. A circulating path 16 is to reverse the side of the sheet from the sheet discharge path 17 in a switchback path, and then, guide again to the register roller pair 7. In the sheet, a toner image is formed on the backside in the image forming section 3. The sheet with the toner image thus formed on one side or both sides is fed to the bookbinding apparatus B from the sheet discharge opening 14 by the sheet discharge roller pair 15.

A scanner unit 20 provided on a top portion of the apparatus main body 1 optically reads an image of an original document. The scanner unit 20 is comprised of platen glass 23 on which the original document is placed by a user, a carriage 21 for optically reading the original document along the platen glass 23, an optical conversion element 22 for performing optical conversion on an optical image from the carriage 21, and the like. Further, on a top portion of the scanner unit 20 is mounted a document feeding apparatus 25 for automatically feeding the original document to the platen glass 23.

The bookbinding apparatus B is disposed, while being connected to the image forming apparatus A. The bookbinding apparatus B forms sheets sent from the image forming apparatus A in the shape of a bunch to create a booklet. In addition, the "booklet" refers to a plurality of bound sheets (sheet bunch). In other words, the "booklet" is not limited to sheets bound by applying an adhesive to an end portion of the sheet bunch shown in this Embodiment. For example, the "booklet" includes sheets where one end side of a sheet bunch is bound, sheets where the sheet is folded and the fold is bound, and the like.

The bookbinding apparatus B is provided with a casing 30, and a collecting section 40 for collecting image-formed sheets in the shape of a bunch, a sheet bunch binding section 55 for applying an adhesive to the sheet bunch from the collecting section 40 to bind, a front cover binding section 60 for binding the sheet bunch applied with the adhesive and a front cover together, a bunch posture changing section 64 for changing the direction of the front-cover-attached sheet bunch with the front cover bound, a cutting section 65 for trimming and cutting an edge of the sheet bunch with the direction changed, and a sheet bunch discharge apparatus (sheet transfer apparatus) K for discharging a booklet formed by trimming and cutting, each provided inside the casing 30. In addition, the sheet bunch binding section 55 of this Embodiment described above applies an adhesive to bind the sheet bunch, and may bind a plurality of sheets using a binding tool such as a staple.

Figure 2:
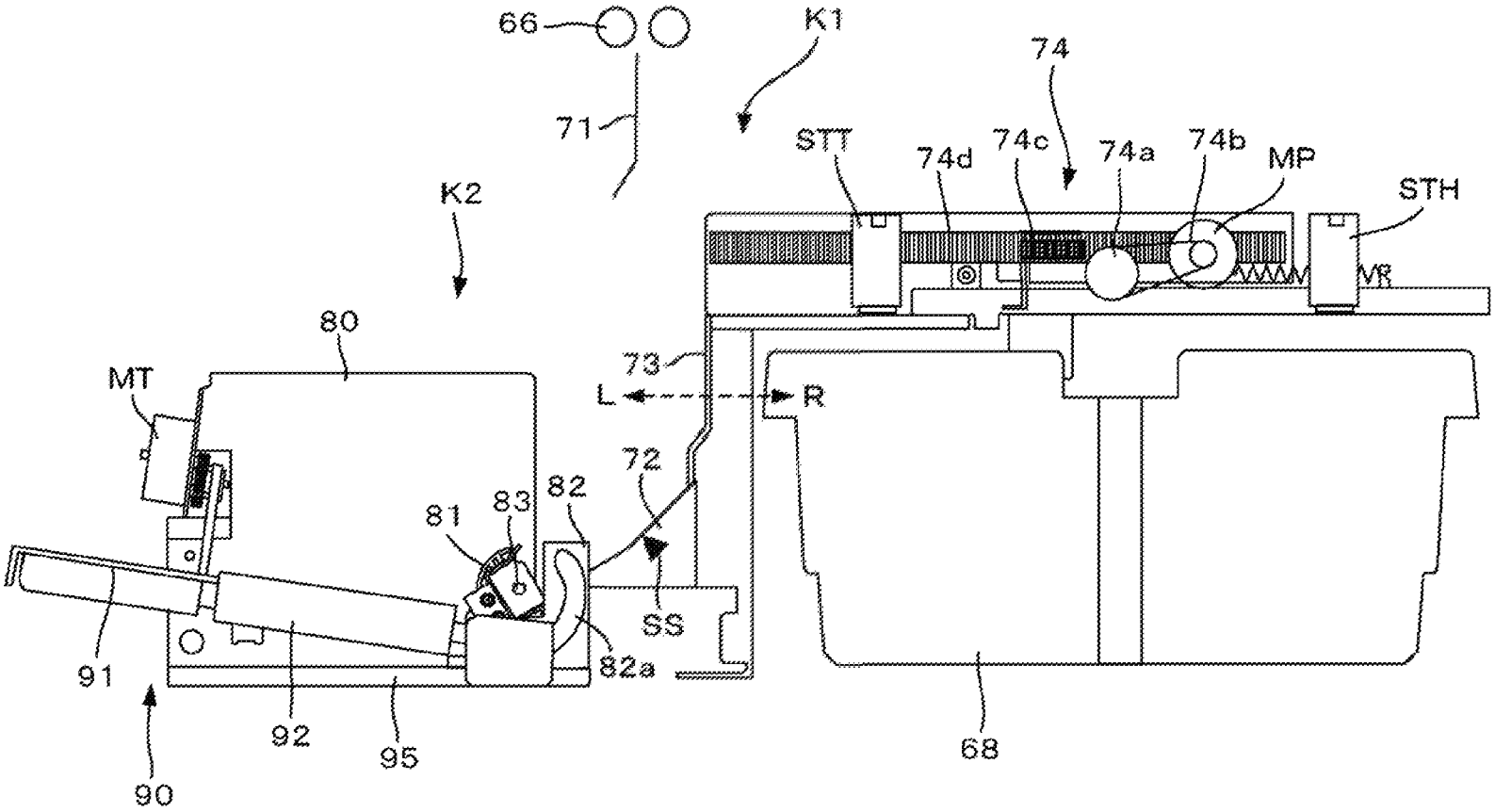
FIG. 2 is a schematic cross-sectional view illustrating a configuration of a sheet bunch discharge apparatus K.
Figure 3:
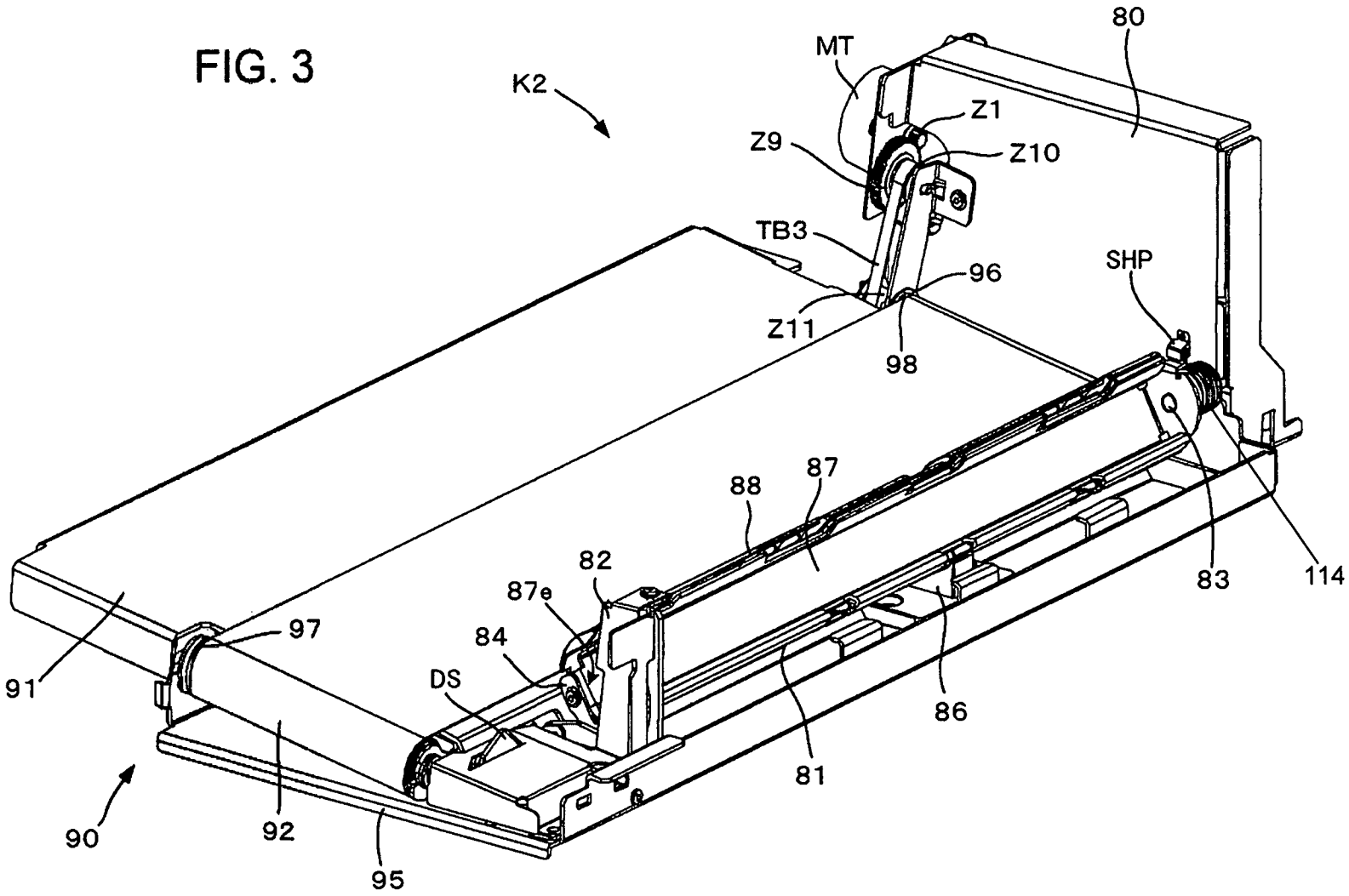
FIG. 3 is a perspective view illustrating a configuration of a sheet bunch discharge unit K2 of the sheet bunch discharge apparatus K.

FIG. 2 is a schematic cross-sectional view illustrating a configuration of the sheet bunch discharge apparatus K, and FIG. 3 is a perspective view illustrating a configuration of a second sheet bunch discharge section K2 of the sheet bunch discharge apparatus K. As shown in FIG. 1, the sheet bunch discharge apparatus K is arranged below a cutting position G. The apparatus K is comprised of a first sheet bunch discharge section K1 for receiving a sheet bunch, and the second sheet bunch discharge section K2 for bringing down the sheet bunch to discharge.

As shown in FIG. 2, the first sheet bunch discharge section K1 is comprised of a sheet bunch discharge roller pair 66, discharge guide 71, push member 73, slope 72, slope sensor SS, push member home position sensor STH, and push position detecting sensor STT. On the other hand, the second sheet bunch discharge section K2 is comprised of a back receiver (holding section) 81, support member 86 of the back receiver 81, sending section 90, and back receiver home position sensor SHP.

The push member 73 is configured to be able to reciprocate and shift in directions (arrows L, R directions) crossing a direction in which a booklet P is dropped by a drive section 74. The push member 73 shifts in the arrow L direction, and thereby brings down the booklet P dropped onto the back receiver 81 to the sending section 90 side. The drive section 74 of the push member 73 is provided on a top portion of a recovery container 68. As shown in FIG. 2, the drive section 74 is comprised of a motor MP, a pulley 74*a*, a belt 74*b* looped between the motor MP and the pulley 74*a*, a pinion 74*c* rotation-interlocked with the pulley 74*a* via a gear mechanism (not shown), and a rack 74*d* provided in the push member 73 along the longitudinal direction of the push member 73 to mesh with the pinion 74*c*. The drive section 74 is to convey forward/backward rotation drive of the motor MP to the pinion 74*c* via the belt 74*b* and pulley 74*a*, and cause the push member 73 to reciprocate and shift in the arrows L, R directions integrally with the rack 74*d*.

The slope 72 is arranged between the recovery container 68 and the back receiver 81. The slope 72 is formed so that the back receiver 81 side is a downward slope. The slope 72 and push member 73 are formed, while being spaced in the shape of a sinking comb so as not to mutually interfere when the push member 73 shifts.

The back receiver 81, support member 86 and sending section 90 constituting the second sheet bunch discharge section K2 are attached to a plate-shaped bottom plate 95 and frame 80 to be integrated, and are made a sheet bunch discharge unit as shown in FIG. 3. In addition, thereafter, for convenience, the second sheet bunch discharge section K2 is referred to as a sheet bunch discharge unit K2.

Figure 4A:
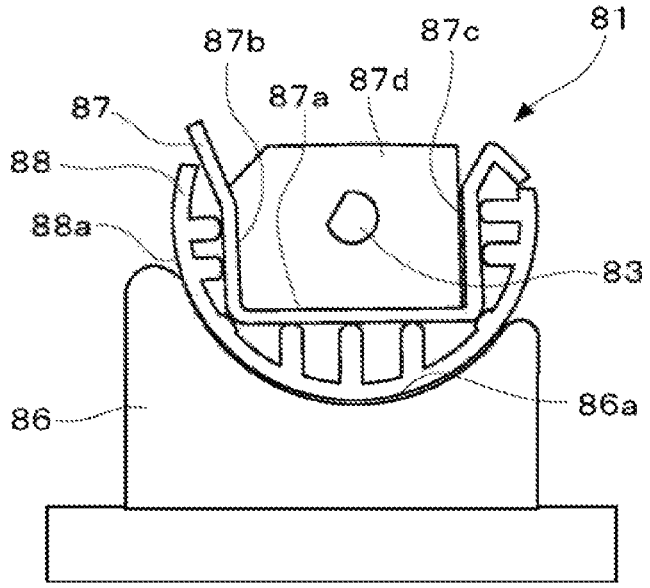
FIGS. 4A and 4B contain cross-sectional views illustrating a back receiver 81 and a configuration for supporting the back receiver 81.
Figure 4B:
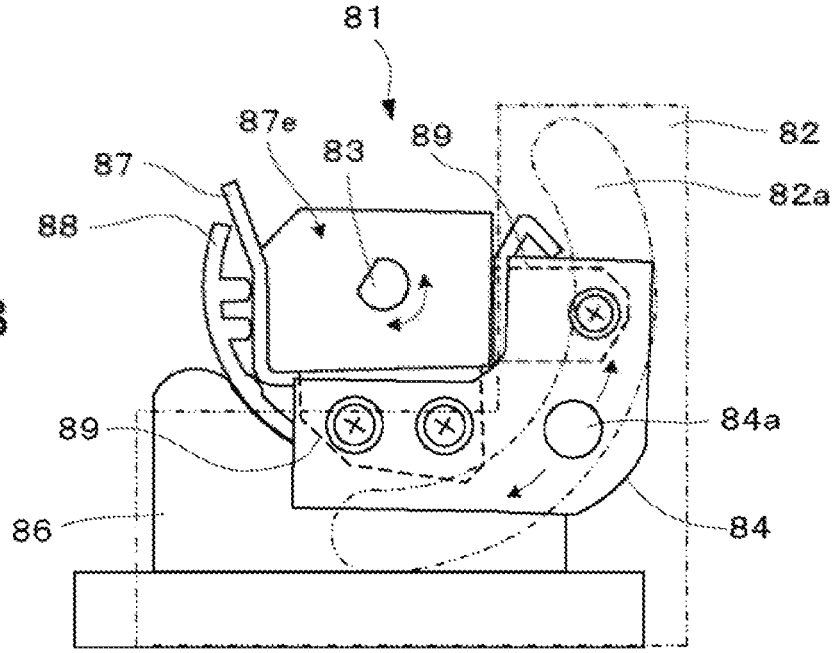

FIGS. 4A and 4B contain cross-sectional views illustrating the back receiver 81 and a configuration for supporting the back receiver 81. The back receiver 81 is configured to receive the dropped booklet P to rotate, and thereby bring down the sheet bunch to the sending section 90 side. As shown in FIGS. 4A and 4B, the back receiver 81 is comprised of a receiving member 87 extending long in a top-tail-edge direction of the booklet P of cross section in the shape of a C, and a contact member 88 provided to cover the receiving member 87. The contact member 88 has a contact face 88*a* with its external face formed in the shape of an arc. In addition, in the booklet P, the end portion on the bound side is called a "back portion", and the end portion on the non-bound side is called a "fore edge". Further, the end edge on the upper side of the booklet P is called a "top edge", and the lower side of the booklet P is called a "tail edge". In other words, opposite end portions in the direction crossing the direction toward the fore edge from the back portion of the booklet P are "top edge" and "tail edge".

The receiving member 87 is to receive the back side of the booklet P in an inner portion in the shape of a C. The C-shaped receiving member 87 has a back receiver bottom 87*a* for receiving the back face of the booklet P, and opposite side faces comprised of back receiver upper guide 87*b* and back receiver lower guide 87*c* opposed, while being spaced a distance of the back receiver bottom 87*a* apart. Further, the receiving member 87 is provided with a side plate 87*d* so as to block the C-shaped inner portion. To the side plate 87*d* is attached a support axis 83 to rotate the back receiver 81. Then, by rotating the back receiver 81 around the support axis 83 as a pivot, the booklet P falls onto the transport belt 92 of the sending section 90.

Further, in the back receiver upper guide 87*b* and back receiver lower guide 87*c*, respective front end portions are folded outward to widen the receiving side so as not to generate edges which the back portion of the booklet P collides with, or is caught in. In addition, the receiving member 87 is preferably formed of stainless steel so that a stain, damage and the like do not occur in the booklet P by generation of rust and the like.

The contact member 88 extends in the top-tail-edge direction of the booklet P along the receiving member 87, and is provided to cover the outer face of the receiving member 87. In the receiving member 87, the outer circumferential face of the contact member 88 has a contact face 88*a* formed in the shape of an arc toward the rotation direction of the back receiver 81. The receiving member 87 is formed of resin. The contact member 88 is fixed to the receiving member 87 with a fixing tool such as a screw. In other words, the contact member 88 is integrated with the receiving member 87 to cover the receiving member 87, and is supported rotatably by the arc-shaped contact face 88*a* brought into contact with a support face 86*a* of the support member 86. Further, the contact member 88 is provided to fill a gap between the receiving member 87 and the transport belt 92 when the back receiver 81 rotates. By this means, it is possible to place the booklet P onto the transport belt 92 in a stable state without being caught.

As described above, the support member 86 comes into contact with the contact face 88*a* of the contact member 88, and thereby supports the back receiver 81. The support face 86*a* of the support member 86 coming into contact with the contact face 88*a* of the contact member 88 is curved and formed along the curvature of the contact face 88*a* formed in the shape of an arc. In addition, the support member 86 is also formed of resin, as the contact member 88.

As shown in FIG. 3, the support member 86 is disposed in the center position of the booklet P transported with the center as reference. In other words, in the transported booklet P, irrespective of whether the size is different, since the center position in the top-tail-edge direction is certain, the center of the booklet P is always received in the same position of the back receiver 81. The position of the back receiver 81 for receiving the center of the booklet P is supported by the support member 87. By this means, balance of the back receiver 81 is stabilized in receiving the booklet P, and the rotation load on the back receiver 81 is reduced to smooth rotation.

The width of the back receiver 81 in the longitudinal direction in the support face 86*a* of the support member 86 is formed at 20 mm in this Embodiment. Further, the support member 86 supports the back receiver 81 so that the back receiver 81 extending in the longitudinal direction is parallel with an extension of the support axis 83. By this means, since the back receiver 81 is not inclined from the extension of the support axis by the support member 86, it is possible to rotate the back receiver 81 stably without fluctuations. In addition, it is also possible to set the support member 86 for the appropriate number and support positions corresponding to the length of the receiving member 87 in the longitudinal direction.

In this Embodiment, in order to reduce the rotation load on the back receiver 81, a single support member 86 supports the back receiver 81, and a plurality of support members 86 may be disposed along the longitudinal direction of the back receiver 81 to support the back receiver 81. In addition, it is also possible to set the support member 86 for the appropriate number and support positions corresponding to the length of the receiving member 87 in the longitudinal direction.

Herein, on the other end side of the back receiver 81 in the longitudinal direction is provided an attachment portion 89 folded at a right angle toward the outside of the shape of a C of the receiving member 87. The attachment portion 89 is shown by dashed lines in FIG. 4B. To the attachment portion 89 is attached an attachment plate 84, and as shown in FIG. 4B, the attachment plate 84 is provided with a guide pin 84*a* to guide the back receiver 81 in the rotation direction. As shown in FIG. 3, a guide plate 82 formed in the shape of an L is provided on the bottom plate 95 on the other end side of the back receiver 81 in the longitudinal direction. This guide plate 82 is provided with an arc-shaped guide hole 82*a* into which is fitted the guide pin 84*a* provided in the attachment plate 84. The guide plate 82 and guide hole 82*a* are shown by virtual lines (alternate long and two short dashed lines) in FIG. 4B. Then, in association with rotation of the back receiver 81, the guide pin 84*a* shifts along the guide hole 82*a*. In other words, the guide hole 82*a* is formed to guide the back receiver 81 in the rotation direction. Further, opposite end portions of the guide hole 82*a* are provided with a function for regulating so that the rotating back receiver 81 does not rotate more than a predetermined amount. In addition, the other end of the receiving member 87 is released so as to discharge the booklet P by the transport belt 92. In FIGS. 3 and 4B, the leased portion is shown by a sign 87*e*.

The sending section 90 is comprised of a conveyor stay (receiving member) 91 and transport belt 92. The transport belt 92 is looped between first and second belt rollers 97, 98 provided on outer sides of the opposite end portions of the conveyor stay 91. The transport belt 92 circulates in the longitudinal direction of the back receiver 81, and rotates the booklet P in the direction orthogonal to the rotation direction of the back receiver 81. The transport belt 92 discharges the booklet P placed on the transport belt 92 by the back receiver 81 outside the apparatus. Further, the transport belt 92 is an endless-shaped belt.

In the conveyor stay 91, the back receiver 81 side is arranged slightly lower. The conveyor stay 91 is arranged also on the inner side of the inner circumference of the endless-shaped transport belt. By this means, the stay 91 supports the booklet P placed on the transport belt 92 by the inner back of the transport belt 92. The conveyor stay 91 has a placement face larger than the transport belt 92 to be able to support portions of the sheet protruding from the transport belt 92.

The transport belt 92 discharges the booklet P placed on the transport belt 92 by the back receiver 81 outside the apparatus. On the opposite sides of the second belt roller 98 with the transport belt 92 attached are provided flanges 96 protruding from the outer circumference of the second belt roller 98. By the flange 96, the transport belt 92 is prevented from being transversely displaced or inclined. In addition, the second belt roller 98 is disposed in a position for not contacting the booklet P when the maximum-size booklet P is placed on the transport belt 92. In other words, the second belt roller 98 is disposed on the apparatus rear side rather than the placement area of the maximum-size booklet P in the transport belt 92. The second belt roller 98 is positioned outside the placement area of the maximum-size booklet P in the transport belt 92, and it is thereby possible to prevent the flange 96 from contacting the booklet P not to cause damage to the booklet P. In addition, in this Embodiment, the first belt roller 97 provided on the front side of the apparatus is not provided with flanges. This is because the flange interferes with discharge of the booklet P when the flange is provided on the opposite sides of the first belt roller 97.

Figure 5:
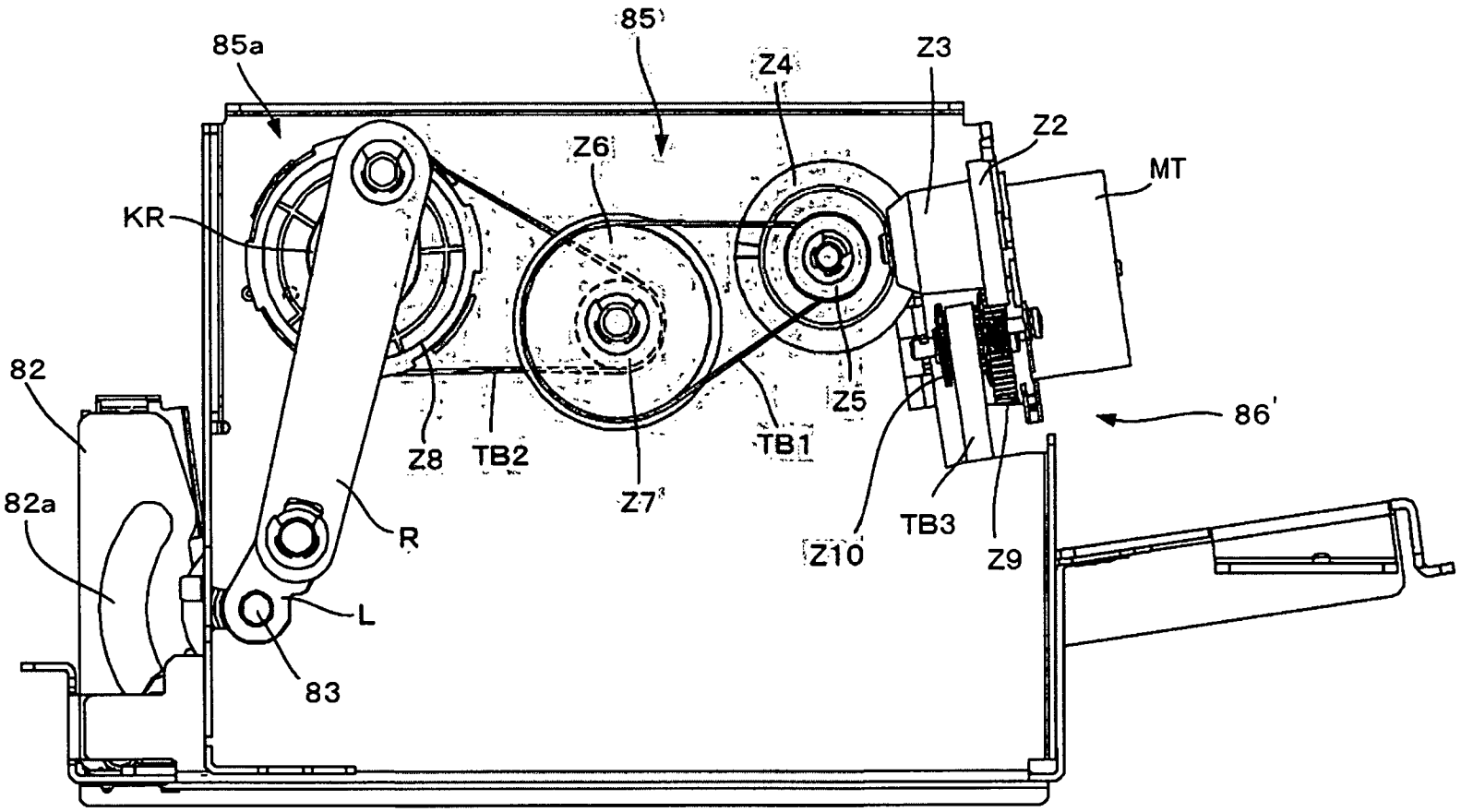
FIG. 5 is a side elevational view of the sheet bunch discharge unit K2 illustrating a drive transfer mechanism for driving the back receiver 81 and transport belt 92.
Figure 6:
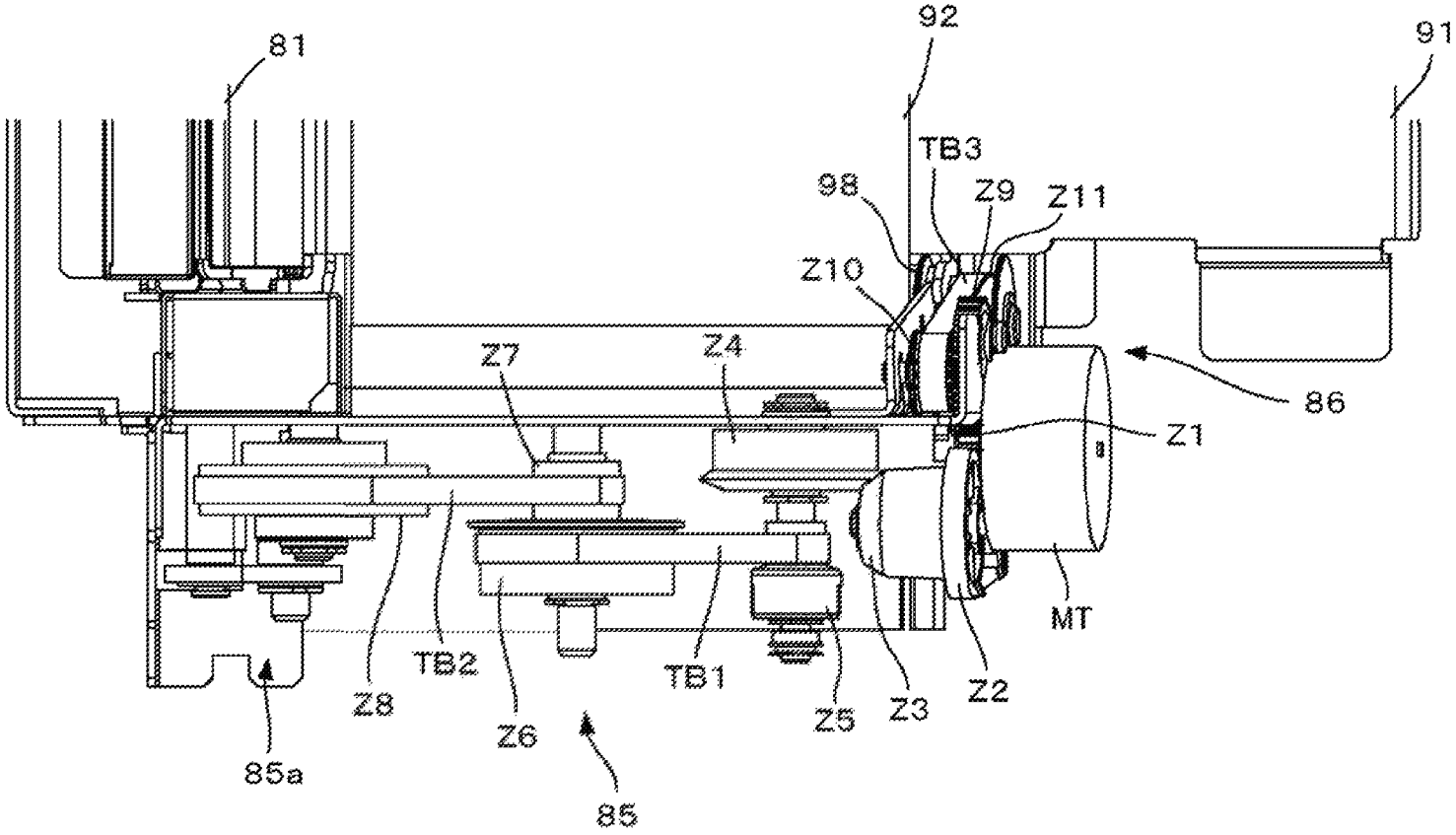
FIG. 6 is a top view of the sheet bunch discharge unit K2 illustrating the drive transfer mechanism for driving the back receiver 81 and transport belt 92.

Described next is a drive transfer mechanism for driving the back receiver 81 and transport belt 92. FIG. 5 is a side elevational view of the sheet bunch discharge unit K2 illustrating the drive transfer mechanism for driving the back receiver 81 and transport belt 92. FIG. 6 is a top view of the sheet bunch discharge unit K2 illustrating the drive transfer mechanism for driving the back receiver 81 and transport belt 92. The drive transfer mechanism is comprised of a first drive transfer mechanism 85 having a crank mechanism 85*a* for transferring backward rotation of a discharge motor MT to the support axis 83 of the back receiver 81, and a second drive transfer mechanism 86 for transferring forward rotation of the discharge motor MT to the transport belt 92.

As shown in FIGS. 5 and 6, the first drive transfer mechanism 85 is provided with a first gear Z1 attached to a drive shaft of the discharge motor MT, a second gear Z2 meshing with the first gear Z1, a first bevel gear Z3 provided on the same axis as that of the second gear Z2, a second bevel gear Z4 meshing with the first bevel gear Z3, a first pulley Z5 with a one-way clutch provided in a rotation axis of the second bevel gear Z4, a first timing belt TB1 looped between the first pulley Z5 and a second pulley Z6, a third pulley Z7 provided on the same axis as that of the second pulley Z6, and a second timing belt TB2 looped between the third pulley Z7 and a fourth pulley Z8 of the crank mechanism 85*a* to transfer drive to the crank mechanism 85*a*. In addition, the first pulley Z5 with the one-way clutch is coupled to the rotation axis of the second bevel gear Z4 when the rotation axis of the second bevel gear Z4 rotates backward by action of the one-way clutch, and is not coupled in forward rotation. In other words, backward rotation of the discharge motor MT is transferred to the clutch mechanism 85*a* via the first pulley Z5, and forward rotation of the discharge motor MT is not transferred to the clutch mechanism 85*a*.

Figure 7B:
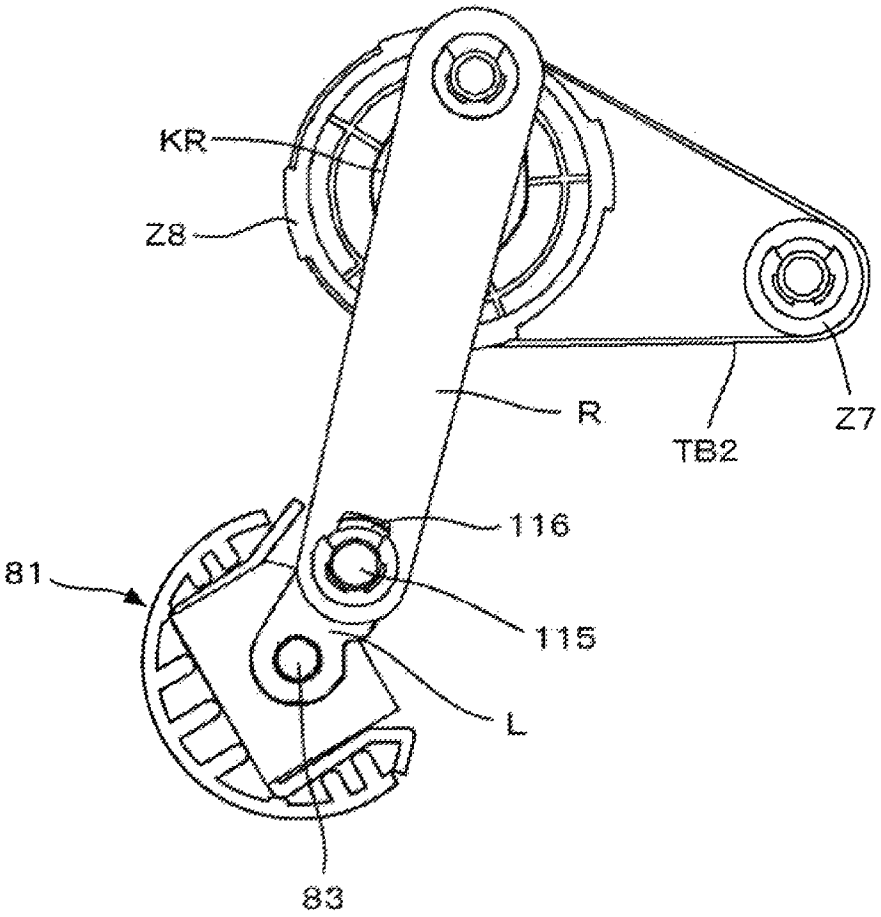
FIGS. 7A and 7B contain views illustrating a configuration and operation states of a crank mechanism 85*a* in a first drive transfer mechanism.
Figure 7A:
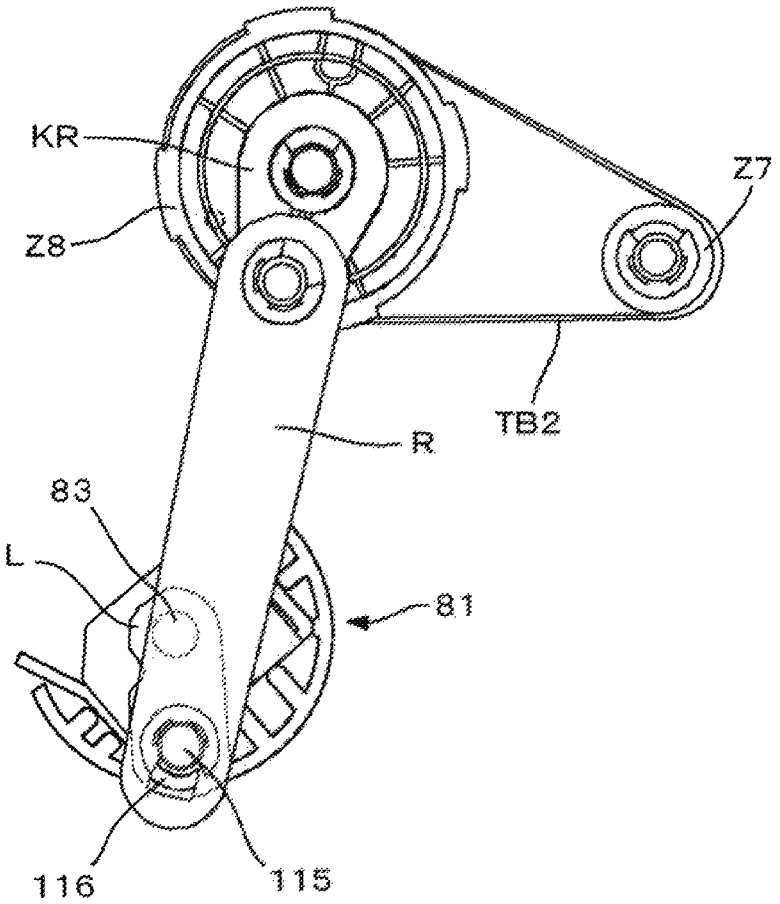

FIGS. 7A and 7B contain views illustrating a configuration and operation states of the crank mechanism 85*a*. The crank mechanism 85*a* is provided with a crank KR attached to a shaft of the fourth pulley Z8 driven via the second timing belt TB2, a rod R with its one end coupled to the crank KR, and a lever L coupled to the other end of the rod R and the support axis 83 of the back receiver 81 to rotate the support axis 83.

The crank mechanism 85*a* convers rotation movement in one direction by the discharge motor MT to a slide shift. Specifically, one end of the crank KR is rotated around the shaft of the fourth pulley Z8, and a coupling portion of the rod R and lever L is thereby subjected to a slide shift. By this slide shift, the support axis 83 is rotated, and the back receiver 81 reciprocates and shifts between a receiving position and a delivery position. In addition, the receiving position is a position in which the back receiver 81 receives the booklet P, and the delivery position is a position for placing the booklet P on the transport belt 92. In this Embodiment, as shown in FIG. 7A, it is configured that the back receiver 81 is positioned in the receiving position in a state in which the coupling portion of the crank KR and the rod R is in the bottom dead center nearest to the support axis 83. On the other hand, as shown in FIG. 7B, it is configured that the back receiver 81 is in the delivery position in a state in which the coupling portion of the crank KR and the rod R is in the top dead center farthest from the support axis 83.

Further, as shown in FIG. 3, a biasing member for biasing the back receiver 81 to the receiving position side is provided between the back receiver 81 and the frame 80. The biasing member is a coil spring 114 attached to the support axis 83. One end of the coil spring 114 is attached to the back receiver 81, and the spring is attached to the frame 80.

Herein, the rod R and lever L are coupled with a coupling pin 115. The coupling pin 115 is provided in the lever L, and is fitted into a long hole 116 provided in the rod R. The long hole 116 is formed in a size that a clearance is formed between the coupling pin 115 and the hole 116. By this means, the rod R is swingable in rotating and shifting around the crank KR, and the crank KR is capable of shifting smoothly. Further, by using the long hole 116, for a period during which the crank KR shifts from a position before the top dead center by a predetermined angle to a position for passing through the top dead center by a predetermined angle, the drive transferred from the crank KR to the rod R is not transferred to the lever L. In other words, in a state of halting in the top dead center of the crank KR, the lever L is free in a certain range by the clearance between the long hole 116 and the coupling pin 115. By this means, the back receiver 81 is also in a free state. At this point, since the back receiver 81 is biased to the receiving position side by the biasing member 114, the back receiver 81 rotates to the receiving position side. In the rotating back receiver 81, the guide pin 84*a* of the attachment plate 84 attached to the back receiver 81 comes into contact with one end portion of the guide hole 82*a* of the guide plate 82, and the back receiver 81 is halted. In this Embodiment, a position of the back receiver 81 in which the guide pin 84*a* comes into contact with one end of the guide hole 82*a* is made the receiving position of the back receiver 81. Accordingly, the back receiver 81 is reliably positioned in the receiving position. Further, even when the halt position of the crank KR fluctuates due to part tolerances and fluctuations in the attachment position of each of the gears and pulleys, it is possible to reliably position the back receiver 81 in the receiving position. Further, the long hole 116 also has a role in interrupting a transfer of an impact load imposed in receiving the booklet P on the back receiver 81 to the crank mechanism 85*a*.

The second drive transfer mechanism 86' is comprised of a third gear Z9 meshing with the first gear Z1 attached to the drive shaft of the discharge motor MT, a fourth pulley Z10 with a one-way clutch provided in a rotation axis of the third gear Z9, a fifth pulley Z11 provided in a shaft of the first belt roller 97, and a third timing belt TB3 looped between the fourth pulley Z10 with the one-way clutch and the fifth pulley Z11. The second drive transfer mechanism 86' transfers forward rotation of the discharge motor MT to the shaft of the first belt roller 97 to rotate the first belt roller 97. Then, by rotating the first belt roller 97, the transport belt 92 is rotated. In addition, by the function of the fourth pulley Z10 with the one-way clutch, the fourth pulley Z10 does not rotate in backward rotation of the discharge motor MT. By this means, the transport belt 92 does not rotate in backward rotation of the discharge motor MT.

Figure 8:
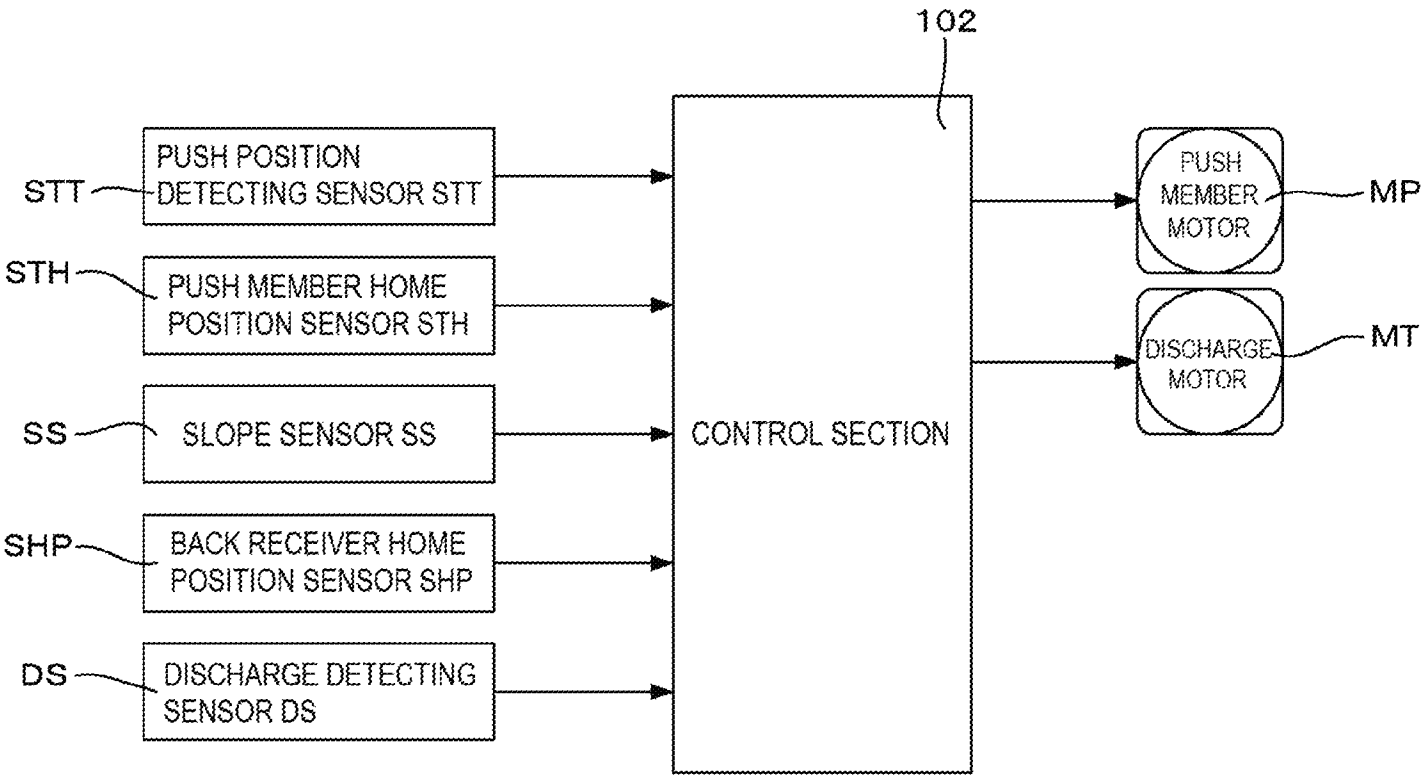
FIG. 8 is a block diagram illustrating a control system of the sheet bunch discharge apparatus K.

FIG. 8 is a control system block diagram of the sheet bunch discharge apparatus K. The sheet bunch discharge apparatus K is provided with a push position detecting sensor STT, push member home position sensor STH, slope sensor SS, back receiver home position sensor SHP, and discharge detecting sensor DS. A control section 102 controls the push member motor MP and discharge motor MT to execute discharge operation of the booklet P, based on a detection status from each sensor and various kinds of information from the image forming apparatus A.

Figure 9:
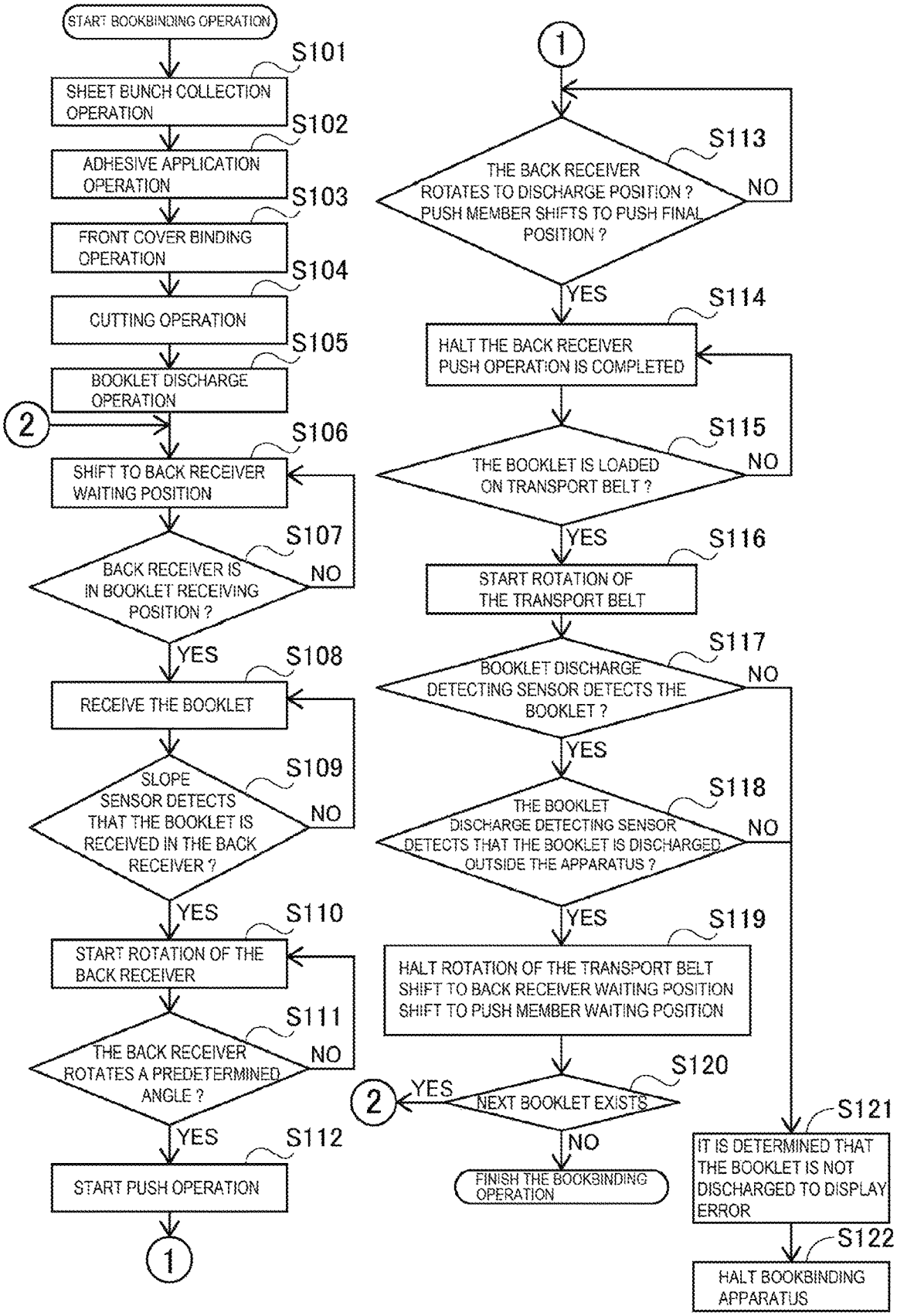
FIG. 9 is a flowchart illustrating bookbinding operation of a bookbinding apparatus B.
Figure 10:
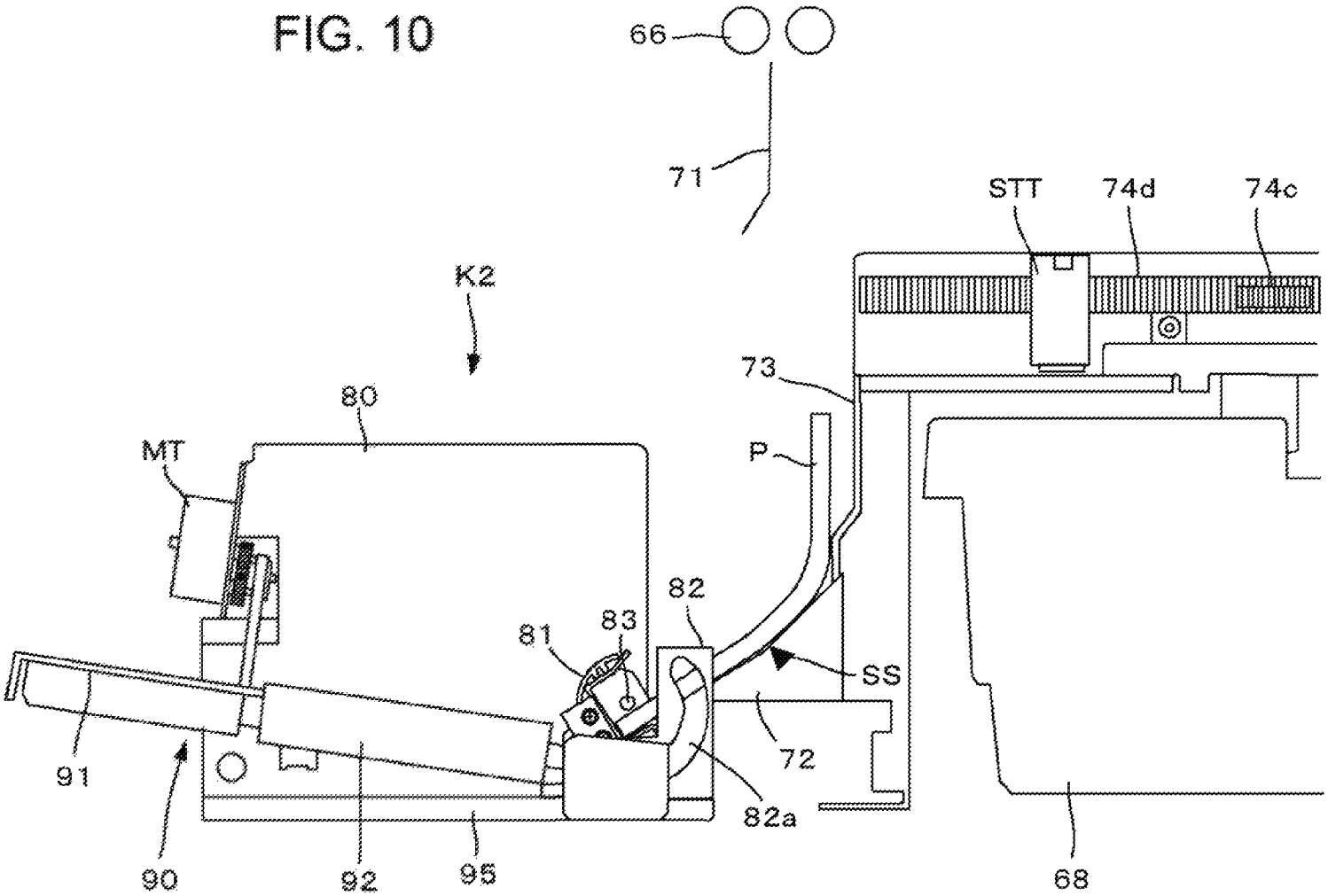
FIG. 10 is a state view illustrating a state of a booklet P in the sheet bunch discharge apparatus K.
Figure 11:
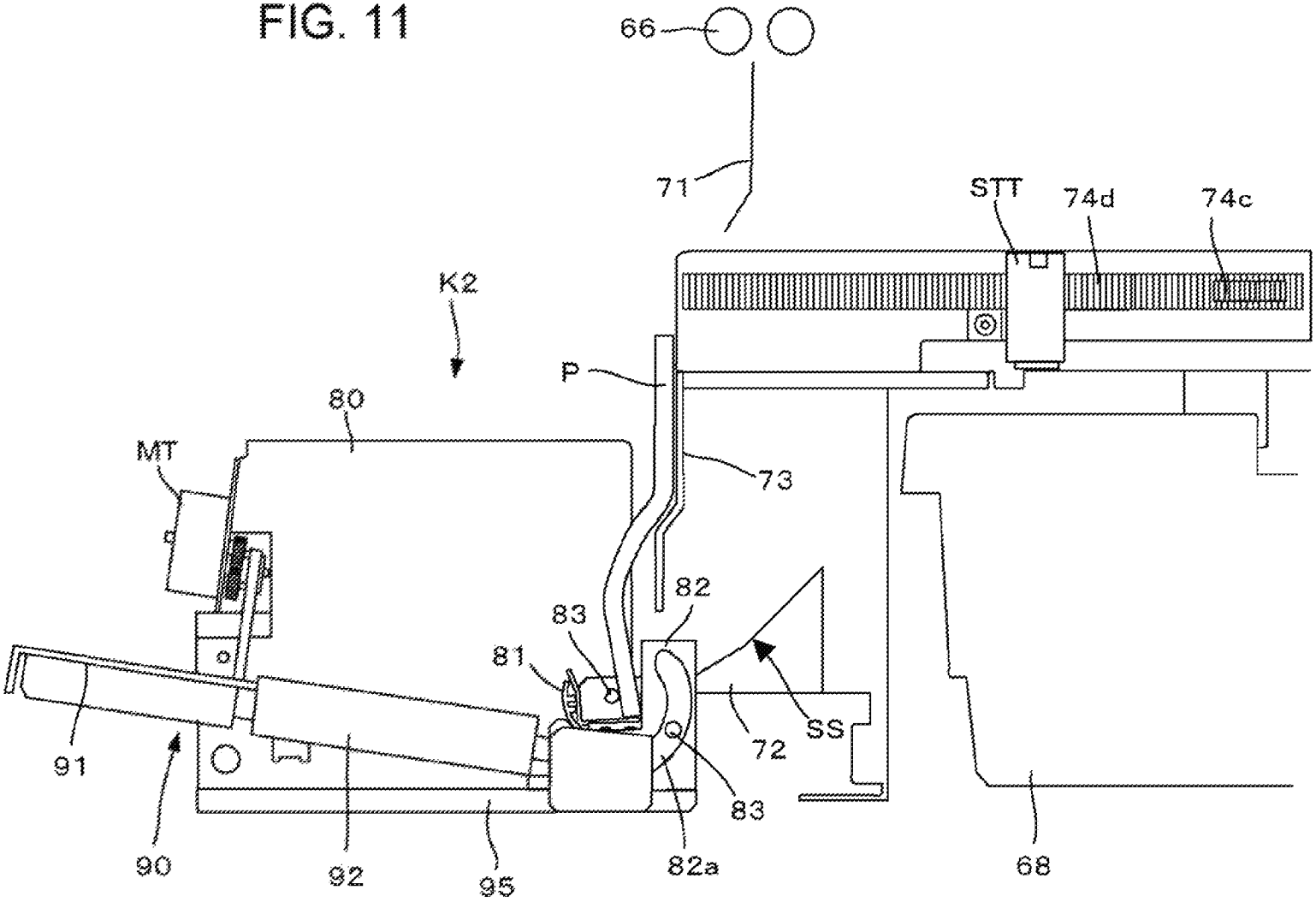
FIG. 11 is another state view illustrating the state of the booklet P in the sheet bunch discharge apparatus K.
Figure 12:
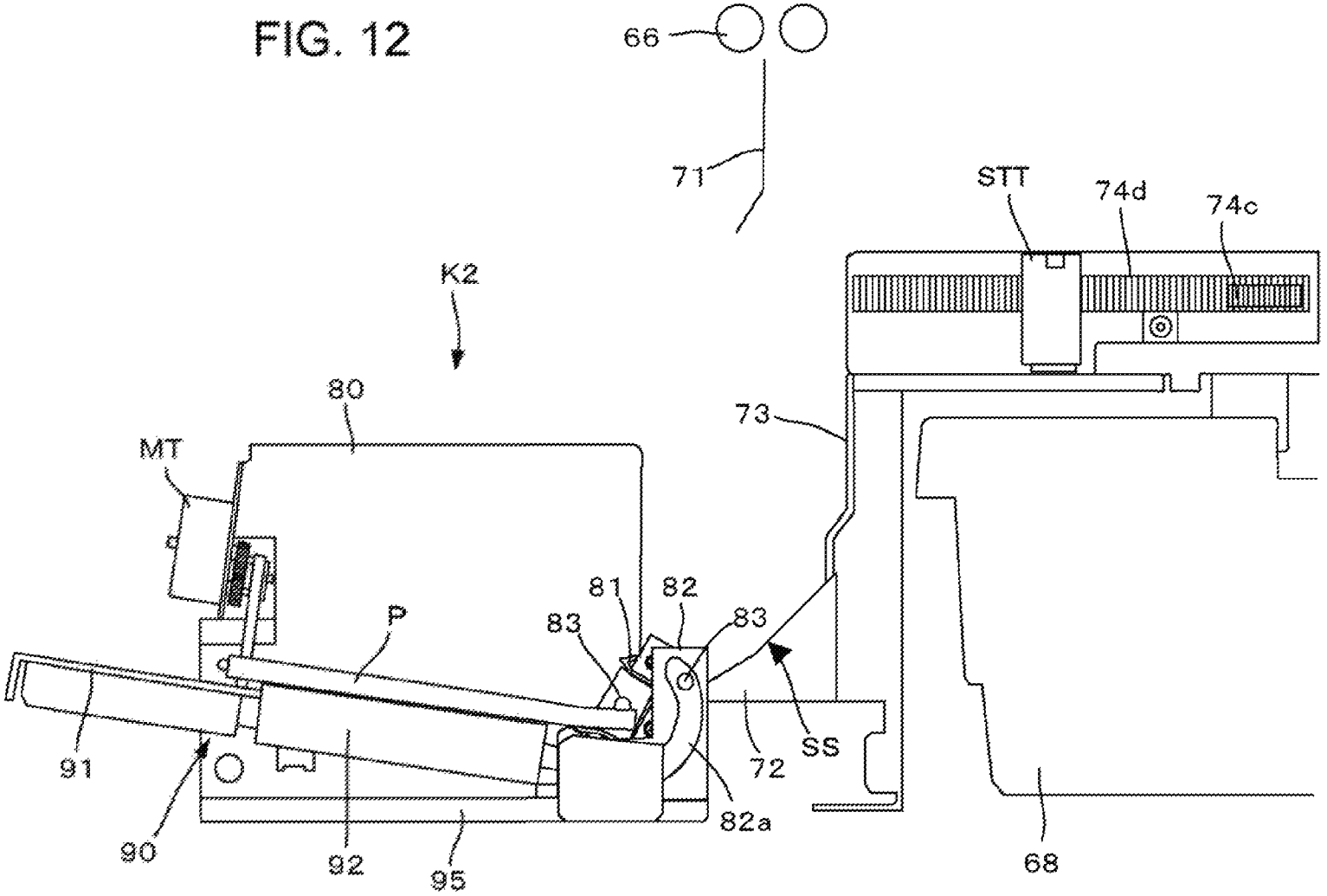
FIG. 12 is still another state view illustrating the state of the booklet P in the sheet bunch discharge apparatus K.

FIG. 9 is a flowchart illustrating bookbinding operation of the bookbinding apparatus B. Further, FIGS. 10 to 12 are state views illustrating states of the booklet P in the sheet bunch discharge apparatus K. As shown in FIG. 9, in sheet bunch collection operation (S101), the collecting section 40 shown in FIG. 1 collects. In adhesive application operation (S102), an adhesive is applied to a sheet bunch from the collecting section 40. In front cover binding operation (S103), a front cover is bound to the sheet bunch with the adhesive applied. In cutting operation (S104), a direction of the sheet bunch with the front cover subjected to front cover binding is changed, and edges of the direction-changed sheet bunch are trimmed and cut. In booklet discharge operation (S105), the booklet P formed by trimming and cutting is discharged to the sheet bunch discharge apparatus K.

In the sheet bunch discharge apparatus K, the discharge motor MT is driven to rotate backward, and the back receiver 81 is rotated to the receiving position side. By this means, the back receiver 81 is shifted to the receiving position (back receiver waiting position) of the booklet P (S106). Then, it is determined whether the back receiver 81 is in the receiving position of the booklet P (S107). In other words, in S107, when the back receiver 81 is detected by the back receiver home position sensor SHP, it is determined that the back receiver 81 arrives at the receiving position of the booklet P, and the discharge motor MT is halted.

Then, when it is detected that the back receiver 81 is in the receiving position by the back receiver home position sensor SHP, the booklet from the sheet bunch discharge roller pair 66 is guided by a receipt discharge guide 71 and slope 72, and slides into the back receiver 81. By this means, as shown in FIG. 10, the back portion of the booklet P is received in the back receiver 81 (S108).

Herein, the back receiver lower guide 81*b* is positioned substantially parallel with a slope inclined face of the slope 72, and is in a position lower than the slope inclined face. By this means, it is possible to reliably receive the booklet P, which slides and drops from the inclined face of the slope 72, in the back receiver 81, without the booklet P being caught in the back receiver lower guide 81*c*. Further, since the back receiver bottom 87*a* is formed substantially at a right angle with respect to the back receiver lower guide 81*c*, the back portion of the booklet P is in an intimate contact state with the back receiver bottom 87*a*, and it is possible to receive in a stable posture.

The control section 102 determines whether the booklet P is received in the back receiver 81 by detection operation of the slope sensor SS, and when the booklet is received in the back receiver 81 (S109), drives the discharge motor MT to rotate backward to rotate the back receiver 81 to the delivery position side (S110). Then, it is detected that the back receiver 81 is rotated to a predetermined angle based on drive pulses of the discharge motor MT (S111). When the back receiver 81 is rotated to the predetermined angle, push operation is executed (S112). In the push operation, the push member motor MP is rotated to start shifting the push member 73 in the L direction shown in FIG. 11. In other words, the push member 73 is to start operation after the start of rotation of the back receiver 81. The push member 73 is positioned on the upstream side from the back receiver 81. As shown in FIG. 11, the push member 73 starts operation, and in cooperation with the back receiver 81, pushes an upstream position from the back receiver 81 of the booklet P from behind in a direction of bringing down the booklet onto the transport belt 92.

When it is detected that the push member 73 shifts to a push final position with the push position detecting sensor STT (S113), the rotation of the push member motor MP is halted to complete the push operation (S114). Concurrently, based on the drive pulse of the discharge motor MT, it is detected whether the back receiver 81 rotates to a discharge position (S113). Then, when the back receiver 81 rotates to the discharge position, the discharge motor MT is halted (S114). At this point, the booklet P is in a state of being loaded on the transport belt 92 as shown in FIG. 12, and when the booklet P is loaded on the transport belt 92 (S115), the discharge motor MT is driven to rotate forward to start rotation of the transport belt 92 (S116).

Herein, when the back receiver 81 finishes rotation operation and loads the booklet P on the transport belt 92, the back receiver upper guide 87*b* is substantially parallel with the angle of the conveyor stay 91, and halts in a position lower than the conveyor stay 91. As a result, when the transport belt 92 transports the booklet P to discharge to the front side of the bookbinding apparatus B, it is possible to decrease a portion that the frontside of the booklet P contacts the back receiver upper guide 87*b*. By this means, it is possible to reduce the transport load of the booklet P, and prevent the front cover from being flawed. In addition, the sheet bunch sending section 90 is inclined so that the back portion of the booklet P loaded on the transport belt 92 is lower than the fore edge. In other words, the sheet bunch sending section 90 is disposed, while being inclined in the direction of decreasing the angle at which the booklet P falls with respect to the horizontal direction.

In addition, in this Embodiment, circulation of the transport belt 92 is started at predetermined timing after halting rotation of the push member motor MP, and a sensor may be provided to detect that the booklet P is placed on the transport belt 92.

As the position for the push member 73 to push the booklet i.e. the position protruding to the booklet P side of the push member 73, it is preferable that the position includes a lower portion from the center in the height direction of the booklet, and a plurality of positions allocated substantially equidistantly from the center in the width direction of the booklet P. By setting at such positions, it is possible to stabilize the behavior when the booklet P falls, and to reduce fluctuations in the position of the booklet P on the transport belt 92.

When the transport belt 92 rotates, the booklet P shifts, in the direction orthogonal to the rotation direction of the back receiver 81, toward the front side of the apparatus. At this point, the back portion of the booklet P transported by the transport belt 92 shifts inside the receiving member 87, while being supported by the back receiver upper guide 87*b* of the receiving member 87 in the back receiver 81. Then, the back portion of the booklet P shifts to a guide face of the support plate 93 via the other end side of the released receiving member 87, and is discharged outside.

The discharge detecting sensor DS is disposed on the guide face of the support plate 93. When the discharge detecting sensor DS detects the booklet P transported by the transport belt 92 i.e. detects the front end of the booklet P in the transport direction, it is determined that the discharge of the booklet P is started (S117). When the discharge detecting sensor DS detects the rear end of the booklet P in the transport direction, it is determined that the booklet P is discharged outside the apparatus.

When it is determined that the booklet P is discharged outside the apparatus, the transport belt 92 is halted, the discharge motor MT is driven to rotate backward to return the back receiver 81 to the receiving position, and the push member motor MP is driven to return the push member 73 to the home position detected by the home position detecting sensor STH. Then, in the case where the next booklet P exists (S120), the flow returns to processing S106, and the same control is repeated until the booklet P does not exist. On the other hand, in the case where the next booklet P does not exist (S120), a series of booklet discharge operation is finished.

In addition, in the case where the booklet P is not detected by the discharge detecting sensor DS in processing S117 (S117), or in the case where the booklet is being detected by the discharge detecting sensor DS (S118), it is assumed that a failure occurs due to that the booklet P does not arrive or remains, an error indication is displayed on a display panel of the image forming apparatus A (S121), and all drive of the bookbinding apparatus B is halted (S122).

In the sheet bunch discharge apparatus K of this Embodiment described above, the case is described where the bound sheet bunch (booklet) is handled, and as a matter of course, the present invention is applicable to the case where the handled sheet is a bunch of sheets that is not bound or a single sheet.

This application claims priority based on Japanese Patent Applications No. 2018-152170, No. 2018-152171 and No. 2018-152172 filed on Aug. 13, 2018, entire contents of which are expressly incorporated by reference herein.

What is claimed is:

1. A sheet transfer apparatus for transferring a sheet, comprising:

a holding section adapted to receive one end side of a sheet to hold;

a support section adapted to support the holding section rotatably; and a receiving section adapted to receive the sheet which is transferred, while rotating the sheet by rotation of the holding section, wherein the holding section includes a back face on a side opposite to a side for receiving a bunch of sheets, and the support section includes a support face for supporting the back face side of the holding section, and wherein an arc-shaped contact face coming into contact with the support face of the support section is formed on the back face of the holding section, and the support face of the support section is curved along the arc-shaped contact face.

2. The sheet transfer apparatus according to claim 1, wherein the support section is disposed in a center portion of the holding section along a rotation axis in a sheet receiving area in the holding section.

3. The sheet transfer apparatus according to claim 1, wherein the holding section includes a receiving member including an opening for receiving one end side of the sheet, and a contact member, attached to the receiving member, supported rotatably by the support section.

4. The sheet transfer apparatus according to claim 1, further comprising:

a push section adapted to come into contact with another end side of the sheet with one end side thereof held by the holding section to shift the sheet to the receiving section in cooperation with the holding section.

5. The sheet transfer apparatus according to claim 1, further comprising:

a rotation axis adapted to rotate the holding section in a direction for standing the sheet and bringing down.

6. A sheet transfer apparatus for transferring a booklet comprised of a bunch of bound sheets, comprising:

a back receiver section adapted to receive a back portion of a booklet on a receiving face and rotate the booklet about a back portion side of the booklet as a pivot; and a support member adapted to come into contact with a back face on a side opposite to the receiving face of the back receiver section to support the back receiver section, wherein the support member includes a curved support face, and the back receiver section shifts along the curved support face of the support member.

7. The sheet transfer apparatus according to claim 6, wherein the back face of the back receiver section is provided with a contact portion coming into contact with and supporting the support face of the support member, and the contact portion is formed in a shape of an arc.

8. The sheet transfer apparatus according to claim 6, wherein the receiving face of the back receiver section is extended in a top-tail-edge direction of the booklet, and the support member is disposed so as to support a center portion of the receiving face in the top-tail-edge direction.

9. The sheet transfer apparatus according to claim 6, wherein the back receiver section includes a receiving member extended in a top-tail-edge direction of the booklet with a concave portion formed, and an inner bottom of the concave portion is the receiving face.

10. The sheet transfer apparatus according to claim 6, wherein the back receiver section is comprised of a receiving member with the receiving face extended in a top-tail-edge direction of the booklet formed, and a contact member attached to the receiving member for supporting the support member.

11. The sheet transfer apparatus according to claim 6, wherein one end of the back receiver section in a top-tail-edge direction is provided with a rotation axis for rotating the back receiver section, and the support member supports so that the back receiver section is parallel with an extension obtained by extending the rotation axis in the top-tail-edge direction.

12. The sheet transfer apparatus according to claim 6, further comprising:

a receiving section adapted to receive the booklet rotated about the back portion side as the pivot in the back receiver section; and a drive section adapted to cause the back receiver section to rotate between a receiving position for receiving the booklet and a delivery position for passing the booklet to the receiving section.

13. A bookbinding apparatus for binding a plurality of sheets to prepare a booklet, comprising:

a collecting section adapted to collect a plurality of sheets;

a binding section adapted to bind a plurality of sheets collected in the collecting section; and a sheet transfer section adapted to transfer a booklet prepared by binding the plurality of sheets in the binding section, wherein the transfer section includes a back receiver section adapted to receive a back portion of the booklet on a receiving face, and rotate the booklet about the back portion side of the booklet as a pivot, a support section adapted to support a back face side on a side opposite to the receiving face of the back receiver section, and a receiving section adapted to receive the booklet rotated about the back portion side as the pivot in the back receiver section, and wherein the back receiver section includes a receiving member with the receiving face extended in a top-tail-edge direction of the booklet formed, and a contact member, attached to the receiving member, with a curved contact face formed, and the support section includes a support member with a curved support face formed to come into contact with the curved contact face formed in the contact member to support the back receiver section.

14. The bookbinding apparatus according to claim 13, wherein the receiving section includes a transport belt adapted to transport the booklet transferred by the back receiver section.

* * * * *